US008721904B2

(12) United States Patent
Kobari

(10) Patent No.: US 8,721,904 B2
(45) Date of Patent: May 13, 2014

(54) METHOD OF MANUFACTURING INKJET HEAD AND THE INKJET HEAD

(75) Inventor: Shinji Kobari, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 24 days.

(21) Appl. No.: 13/495,159

(22) Filed: Jun. 13, 2012

(65) Prior Publication Data

US 2013/0050340 A1 Feb. 28, 2013

(30) Foreign Application Priority Data

Aug. 23, 2011 (JP) ..... 2011-181353

(51) Int. Cl.
*B41J 2/16* (2006.01)

(52) U.S. Cl.
USPC ..... 216/27

(58) Field of Classification Search
USPC ..... 216/27
See application file for complete search history.

(56) References Cited

U.S. PATENT DOCUMENTS 7,163,640 B2 * 1/2007 Yeo et al. ..... 216/27
7,370,415 B2 5/2008 Kikugawa et al.
8,108,998 B2 * 2/2012 Inada et al. ..... 29/890.1

FOREIGN PATENT DOCUMENTS

JP 2002-264342 9/2002

* cited by examiner

*Primary Examiner* — Lamson Nguyen
(74) *Attorney, Agent, or Firm* — Amin, Turocy & Watson, LLP

(57) ABSTRACT

According to one embodiment, a method of manufacturing an inkjet head includes forming metal films respectively on a surface of a base member and a surface of a driving element attached to the base member, and shaving the metal film formed on the base member with a first laser beam and shaving the metal film formed on the driving element with a second laser beam having power different from power of the first laser beam to form a conductor pattern.

14 Claims, 9 Drawing Sheets

METHOD OF MANUFACTURING INKJET HEAD AND THE INKJET HEAD

CROSS-REFERENCE TO RELATED APPLICATIONS

This application is based upon and claims the benefit of priority from prior Japanese Patent Application No. 2011-181353, filed on Aug. 23, 2011, the entire contents of which are incorporated herein by reference.

FIELD

Embodiments described herein relate generally to a method of manufacturing an inkjet head and the inkjet head.

BACKGROUND

Plural conductor patterns are formed on a base plate and a driving element of an inkjet head. The conductor patterns are formed by irradiating a laser beam on, for example, a nickel thin film, which is formed on the surfaces of the base plate and the driving element by electroless plating, and shaving the nickel thin film.

The nickel thin film is provided extending over various portions having different characteristics such as the surface of a base plate formed by alumna and the surface of a driving element formed by lead zirconate titanate (PZT). If the irradiation of the laser beam is performed with fixed power irrespective of such a difference in the characteristics of the bases, it is likely that a patterning defect occurs in which the nickel thin film is partially insufficiently cut. If the cutting of the nickel thin film is insufficient, the nickel thin film is cut by irradiating the laser beam plural times. Therefore, manufacturing costs and time increase.

DETAILED DESCRIPTION

In general, according to one embodiment, a method of manufacturing an inkjet head includes forming metal films respectively on a surface of a base member and a surface of a driving element attached to the base member, and shaving the metal film formed on the base member with a first laser beam and shaving the metal film formed on the driving element with a second laser beam having power different from power of the first laser beam to form a conductor pattern.

Figure 1:
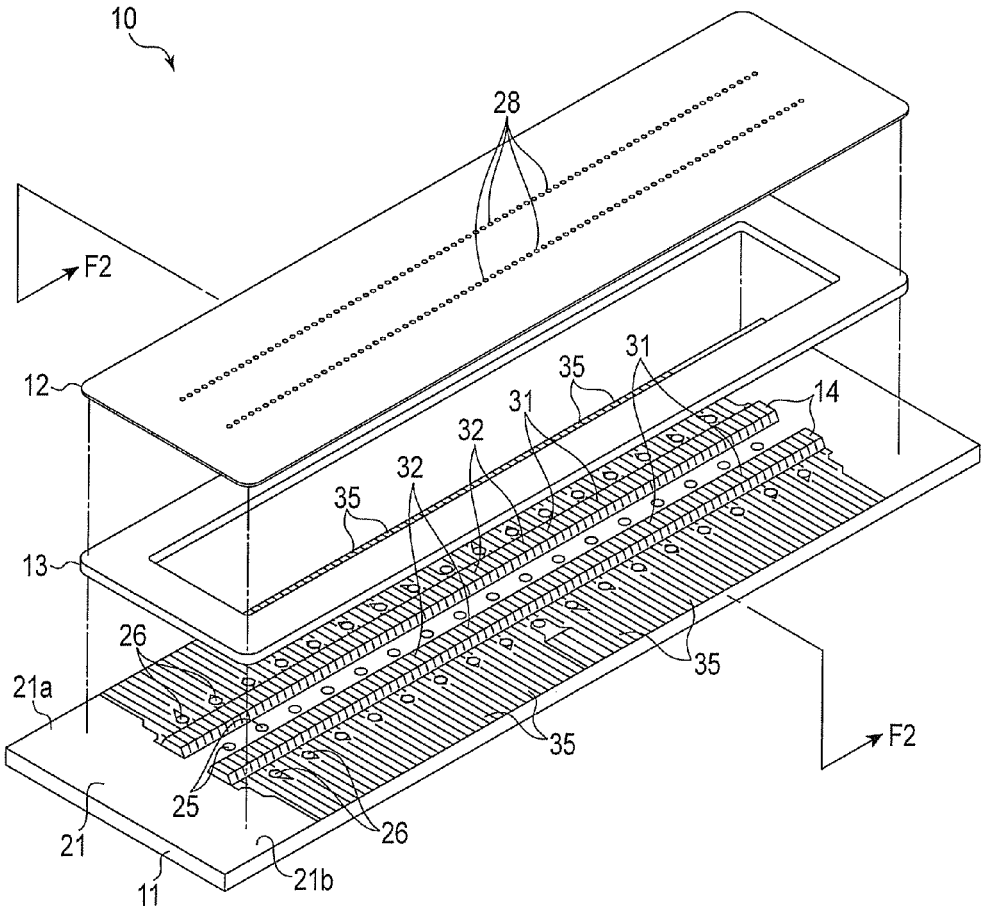
FIG. 1 is a disassembled perspective view of an inkjet head according to an embodiment.
Figure 2:
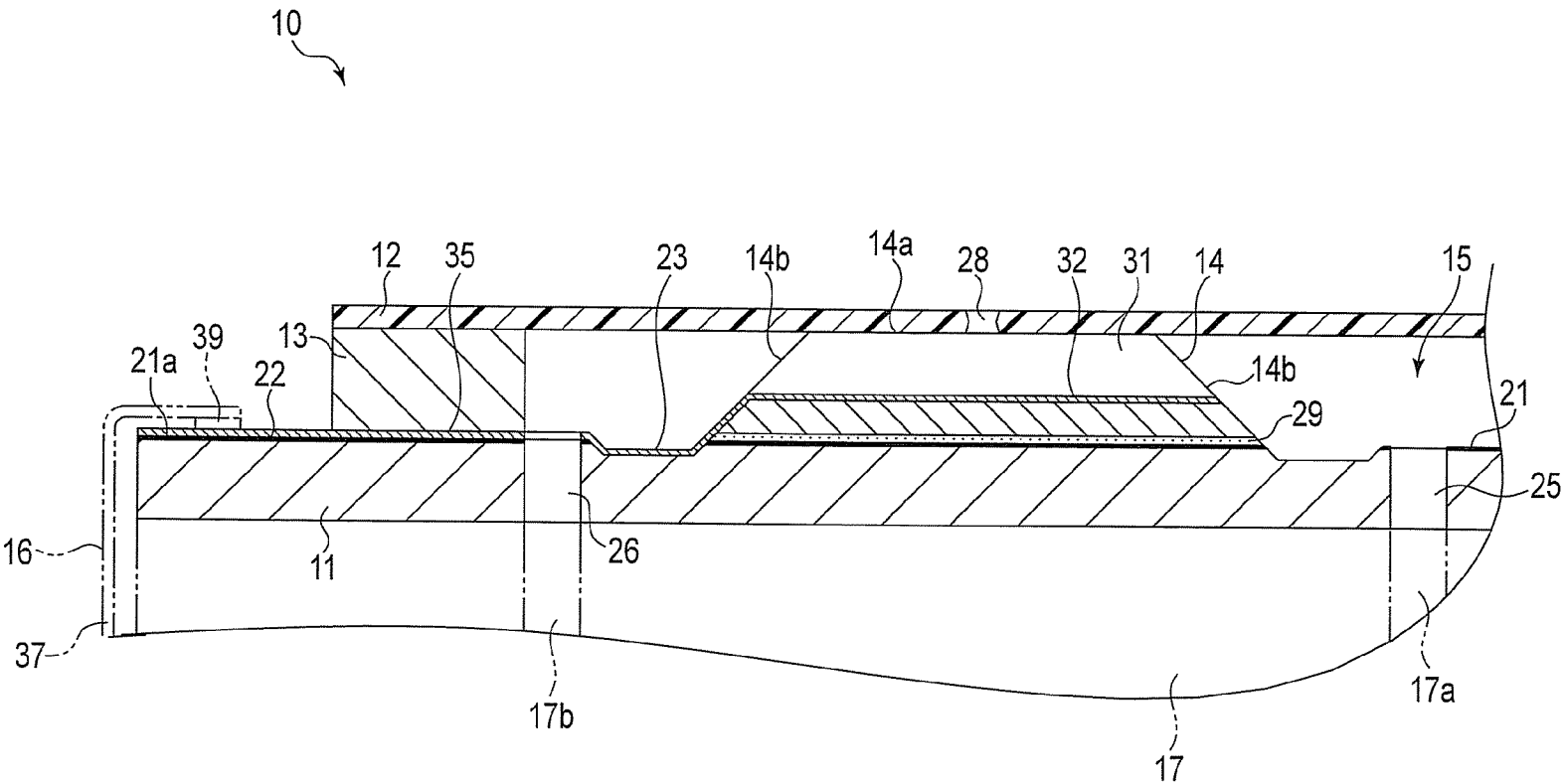
FIG. 2 is a sectional view of the inkjet head taken along line F2-F2 in FIG. 1.

An embodiment is explained below with reference to FIGS. 1 to 10. FIG. 1 is a disassembled perspective view of an inkjet head 10 according to the embodiment. FIG. 2 is a sectional view of a part of the inkjet head 10 taken along line F2-F2 in FIG. 1. As shown in FIG. 1, the inkjet head 10 is an inkjet head of a so-called side shooter type.

The inkjet head 10 is a device for ejecting ink and is mounted on the inside of an inkjet printer. The inkjet head 10 includes a base plate 11, an orifice plate 12, a frame member 13, and a pair of driving elements 14. The base plate 11 is an example of a base member described in claims. As shown in FIG. 2, an ink chamber 15 to which the ink is supplied is formed on the inside of the inkjet head 10.

Further, as indicated by alternate long and two short dashes lines in FIG. 2, various components such as a circuit board 16 that controls the inkjet head 10 and a manifold 17 that forms a part of a path between the inkjet head 10 and an ink tank are attached to the inkjet head 10.

As shown in FIG. 1, the base plate 11 is formed in a rectangular plate shape by ceramics such as alumina. The base plate 11 includes a flat mounting surface 21. The mounting surface 21 is an example of the surface of the base member described in claims. As shown in FIG. 2, the mounting surface 21 includes a first portion 22 and a second portion 23.

The first portion 22 of the mounting surface 21 is a portion, the surface of which is roughened by, for example, etching. In FIG. 2, the first portion 22 is indicated by a thick line. The second portion 23 of the mounting surface 21 is, for example, a portion, the surface of which is ground. The second portion 23 is smoother than the first portion 22.

Plural supply holes 25 and plural discharge holes 26 are opened in the first portion 22 of the mounting surface 21. The supply holes 25 and the discharge holes 26 may be provided in the second portion 23 of the mounting surface 21.

As shown in FIG. 1, the supply holes 25 are provided side by side in a longitudinal direction of the base plate 11 in the center of the base plate 11. As shown in FIG. 2, the supply holes 25 communicate with an ink supply section 17*a* of the manifold 17. The supply holes 25 are connected to the ink tank via the ink supply section 17*a*. The ink in the ink tank is supplied from the supply holes 25 to the ink chamber 15.

As shown in FIG. 1, the discharge holes 26 are provided side by side in two rows across the supply holes 25. As shown in FIG. 2, the discharge holes 26 communicate with an ink discharge section 17*b* of the manifold 17. The discharge holes 26 are connected to the ink tank via the ink discharge section 17*b*. The ink in the ink chamber 15 is collected in the ink tank from the discharge holes 26. In this way, the ink circulates between the ink tank and the ink chamber 15.

As shown in FIG. 1, the orifice plate 12 is formed by, for example, a rectangular film made of polyimide. The orifice plate 12 is opposed to the mounting surface 21 of the base plate 11.

Plural orifices 28 are provided in the orifice plate 12. The plural orifices 28 are arranged side by side in two rows along the longitudinal direction of the orifice plate 12. The orifices 28 are opposed to a portion between the supply holes 25 and the discharge holes 26 of the mounting surface 21.

The frame member 13 is formed in a rectangular frame shape by, for example, a nickel alloy. The frame member 13 is interposed between the mounting surface 21 of the base plate 11 and the orifice plate 12. The frame member 13 is bonded to the mounting surface 21 and the orifice plate 12. In other words, the orifice plate 12 is attached to the base plate 11 via the frame member 13. The ink chamber 15 is formed to be surrounded by the base plate 11, the orifice plate 12, and the frame member 13.

Each of the pair of driving elements 14 is formed by two tabular piezoelectric bodies formed by, for example, lead zirconate titanate (PZT). The two piezoelectric bodies are stuck together such that polarization directions thereof are opposite to each other in the thickness direction thereof. Heat less easily escapes from PZT than alumina.

The pair of driving elements 14 are bonded to the mounting surface 21 of the base plate 11 via a bonding layer 29 shown in FIG. 2. The bonding layer 29 is formed by, for example, an epoxy adhesive having thermosetting properties. The pair of driving elements 14 are arranged in parallel in the ink chamber 15 to correspond to the orifices 28 arranged side by side in two rows.

As shown in FIG. 2, the driving element 14 is formed in a trapezoidal shape in cross section. The driving element 14 includes a top surface 14*a* and a pair of inclined surfaces 14*b*. The inclined surfaces 14*b* are an example of a surface of a driving element described in claims. The top surface 14*a* of the driving element 14 is bonded to the orifice plate 12. The inclined surfaces 14*b* are rougher than the first portion 22 of the mounting surface 21 of the base plate 11.

Plural grooves 31 are provided in the driving elements 14. The grooves 31 extend in a direction crossing the longitudinal direction of the driving elements 14. The grooves 31 are arranged side by side in the longitudinal direction of the driving elements 14. The plural grooves 31 are opposed to the plural orifices 28 of the orifice plate 12.

Electrodes 32 are respectively provided in the plural grooves 31. The electrodes 32 are a part of conductor patterns. The electrodes 32 are formed by, for example, a nickel thin film. The electrodes 32 cover the inner surfaces of the grooves 31.

Plural wiring patterns 35 are provided extending from the mounting surface 21 of the base plate 11 to the driving elements 14. The wiring patterns 35 are a part of the conductor patterns. The wiring patterns 35 are formed by, for example, a nickel thin film.

The wiring patterns 35 respectively extend from one side end 21*a* and the other side end 21*b* of the mounting surface 21 to the driving elements 14. The side ends 21*a* and 21*b* include not only the edges of the mounting surface 21 but also areas around the edges. Therefore, the wiring patterns 35 may be provided further on the inner side than the edges of the mounting surface 21.

The wiring patterns 35 are provided extending over the first portion 22 and the second portion 23 on the mounting surface 21. The wiring patterns 35 are respectively electrically connected to the electrodes 32 through the inclined surfaces 14*b* of the driving elements 14.

The circuit board 16 is a film carrier package (FCP). The circuit board 16 includes a film 37 made of resin having plural wires formed thereon and having flexibility and an IC connected to the plural wires of the film 37. The FCP is also referred to as tape carrier package (TCP).

The film 37 is tape automated bonding (TAB). The IC is a component for applying a voltage to the electrodes 32. The IC is fixed to the film 37 by, for example, resin.

An end of the film 37 is thermocompression-bonded and connected to the wiring patterns 35 by an anisotropic conductive film (ACF) 39. Consequently, the plural wires of the film 37 are electrically connected to the wiring patterns 35.

Since the film 37 is connected to the wiring patterns 35, the IC is electrically connected to the electrodes 32 via the wires. The IC applies a voltage to the electrodes 32 via the wires of the film 37.

When the IC applies the voltage to the electrodes 32, the driving elements 14 are deformed in a share mode, whereby the volume of the grooves in which the electrodes 32 are provided is increased and reduced. Consequently, the pressure of the ink in the grooves 31 changes and the ink is discharged from the orifices 28.

Figure 3:
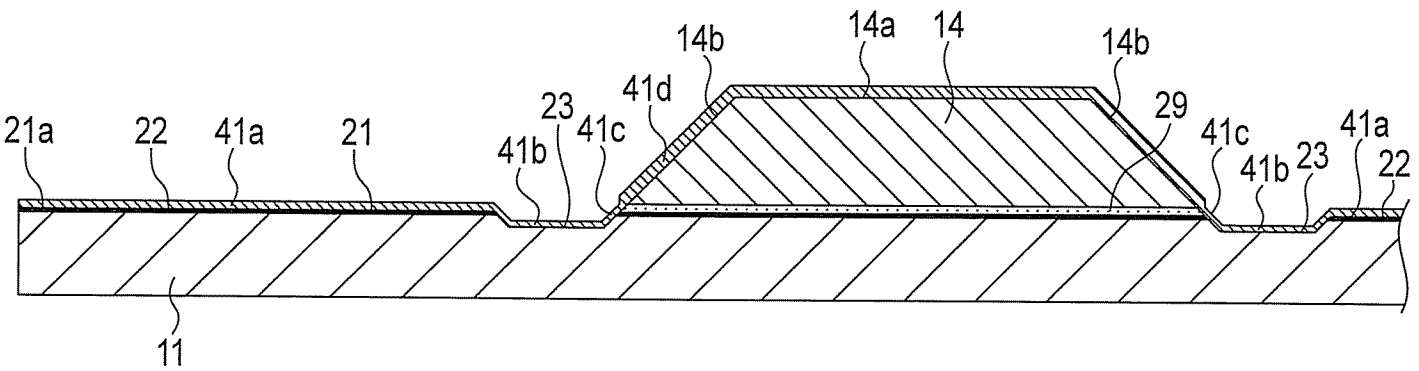
FIG. 3 is a schematic sectional view of a base plate and a driving element on which nickel thin films are formed.

An example of a method of manufacturing the base plate 11, which is a part of a method of manufacturing the inkjet head 10 having the configuration explained above, is explained with reference to FIGS. 3 to 8. FIG. 3 is a schematic sectional view of the base plate 11 and the driving elements 14 on which nickel thin films 41*a*, 41*b*, 41*c*, and 41*d* are formed. In FIG. 3, a section different from the section shown in FIG. 2 is shown.

First, the supply holes 25 and the discharge holes 26 are formed by press molding in the base plate 11 formed by a ceramics sheet (a ceramics green sheet) not baked yet. Subsequently, the base plate 11 is baked.

The mounting surface 21 of the baked base plate 11 is etched. Consequently, the mounting surface 21 becomes rougher than the surface of baked pure alumina. Processing for roughening the mounting surface 21 is not limited to the etching. Other methods may be used to roughen the mounting surface 21.

A pair of piezoelectric bodies having a rectangular shape in cross section, which are formed into the driving elements 14, are bonded to the base plate 11. At this point, a distance between the pair of piezoelectric bodies is maintained constant by a jig. The piezoelectric bodies are positioned on the base plate 11 by the jig and bonded to the base plate 11 by an epoxy adhesive. Since the piezoelectric bodies are bonded to the base plate 11, a bonding layer 29 is formed between the piezoelectric bodies, which are formed into the driving elements 14, and the mounting surface 21 of the base plate 11.

So-called taper machining for grinding corners of the piezoelectric bodies bonded to the base plate 11 is performed. Consequently, the inclined surfaces 14*b* of the driving elements 14 are formed and the cross sections of the piezoelectric bodies, which are formed into the driving elements 14, are formed in a trapezoidal shape.

When the piezoelectric bodies are ground, the bonding layer 29 and the base plate 11 are slightly shaved. Consequently, the etched first portion 22 and the second portion 23 ground to be smoother than the first portion 22 are formed on the mounting surface 21.

The plural grooves 31 are formed in the piezoelectric bodies. The plural grooves 31 are formed by a multi cutter of a dicing saw used for, for example, cutting of an IC wafer. Consequently, the driving elements 14 are formed.

The nickel thin films 41*a*, 41*b*, 41*c*, and 41*d* are formed on the mounting surface 21 of the base plate 11 including the first portion 22 and the second portion 23 and on the top surfaces 14*a* and the inclined surfaces 14*b* of the driving elements 14 by, for example, electroless plating. The nickel thin films 41*a*, 41*b*, 41*c*, and 41*d* are an example of a metal film described in claims.

The nickel thin films 41*a*, 41*b*, 41*c*, and 41*d* are formed integrally with one another. The nickel thin film 41*a* is formed in the first portion 22 of the mounting surface 21. The nickel thin film 41*b* is formed in the second portion 23 of the mounting surface 21. The nickel thin film 41*c* is formed on the surface of the bonding layer 29. The nickel thin film 41*d* is formed on the surfaces of the driving elements 14 including the inner surfaces of the grooves 31 and the top surfaces 14*a*.

Since the roughness of the bases are different, the thickness of the nickel thin films 41*a*, 41*b*, 41*c*, and 41*d* are different from one another. For example, the nickel thin film 41*d* is thicker than the nickel thin film 41*a*. The nickel thin film 41*a* is thicker than the nickel thin film 41*b*. The nickel thin film 41*b* is thicker than the nickel thin film 41*c*.

An adhesion force between the nickel thin film 41*d* and the surface of the driving element 14 is higher than an adhesion force between the nickel thin film 41*a* and the first portion 22. The adhesion force between the nickel thin film 41*a* and the first portion 22 is higher than an adhesion force between the nickel thin film 41*b* and the second portion 23. The adhesion force between the nickel thin film 41*b* and the second portion 23 is higher than an adhesion force between the nickel thin film 41*c* and the surface of the bonding layer 29. The adhesion forces are bonding forces acting on interfaces between the nickel thin films and the bases.

The nickel thin film 41*d* formed on the top surfaces 14*a* of the driving elements 14 is removed. The nickel thin film 41*d* on the top surfaces 14*a* is removed by, for example, abrasive machining.

Figure 4:
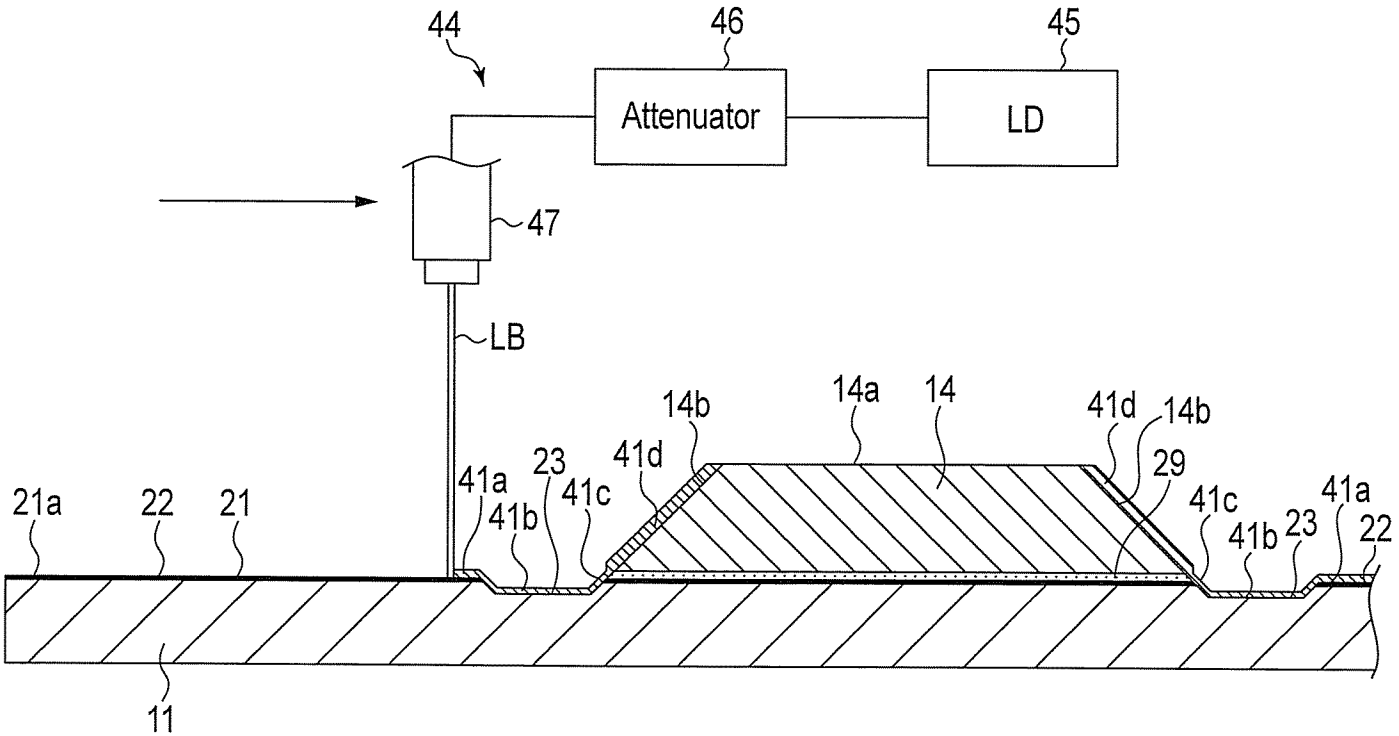
FIG. 4 is a schematic sectional view of the base plate and the driving element for explaining a process for shaving the nickel thin film in a first portion.

FIG. 4 is a schematic sectional view of the base plate 11 and the driving element 14 for explaining a process for shaving the nickel thin film 41*a*. As explained below, the nickel thin films 41*a*, 41*b*, 41*c*, and 41*d* are patterned to form the electrodes 32 and the wiring patterns 35 by a laser machining apparatus 44 shown in FIG. 4.

The laser machining apparatus 44 includes a laser diode 45, an attenuator 46, and a beam emitting section 47. As shown in FIG. 4, the laser machining apparatus 44 vertically irradiates a laser beam LB on the base plate 11. The laser machining apparatus 44 may irradiate the laser beam LB in a direction tilting with respect to the base plate 11.

The laser diode 45 radiates the laser beam LB. The power of the laser beam LB radiated by the laser diode 45 is proportional to an electric current applied to the laser diode 45. A component that radiates the laser beam LB is not limited to the laser diode. A component of another type such as a gas laser may be used. The power of the laser beam is an energy amount per unit time.

The attenuator 46 variably reduces the power of the laser beam LB radiated by the laser diode 45. For example, the attenuator 46 includes a glass plate that changes an incident angle of the laser beam LB to thereby change reflectance. The glass plate is caused to pivot to change the incident angle of the laser beam LB, whereby an attenuation ratio of the laser beam LB changes. The attenuator 46 is not limited to this and may be an attenuator including, for example, a glass plate on which a gradation-like film is formed or a $\lambda/2$ wave plate.

The beam emitting section 47 is a section where the laser beam LB is emitted to the outside of the laser machining apparatus 44. The laser machining apparatus 44 can move to change a distance between the beam emitting section 47 and a machining point. The machining point is a portion where the laser beam LB is irradiated. As the distance between the beam emitting section 47 and the machining point is shorter, the power of the laser beam LB at the machining point is higher.

First, the laser beam LB is irradiated on an end of the nickel thin film 41*a* located at one side end 21*a* of the mounting surface 21 by the laser machining apparatus 44. As shown in FIG. 4, for example, the base plate 11 is moved to move the machining point of the laser beam LB toward the driving element 14, whereby the nickel thin film 41*a* is shaved by the laser beam LB. The machining point of the laser beam LB may meander according to the shape of the wiring patterns 35.

Figure 5:
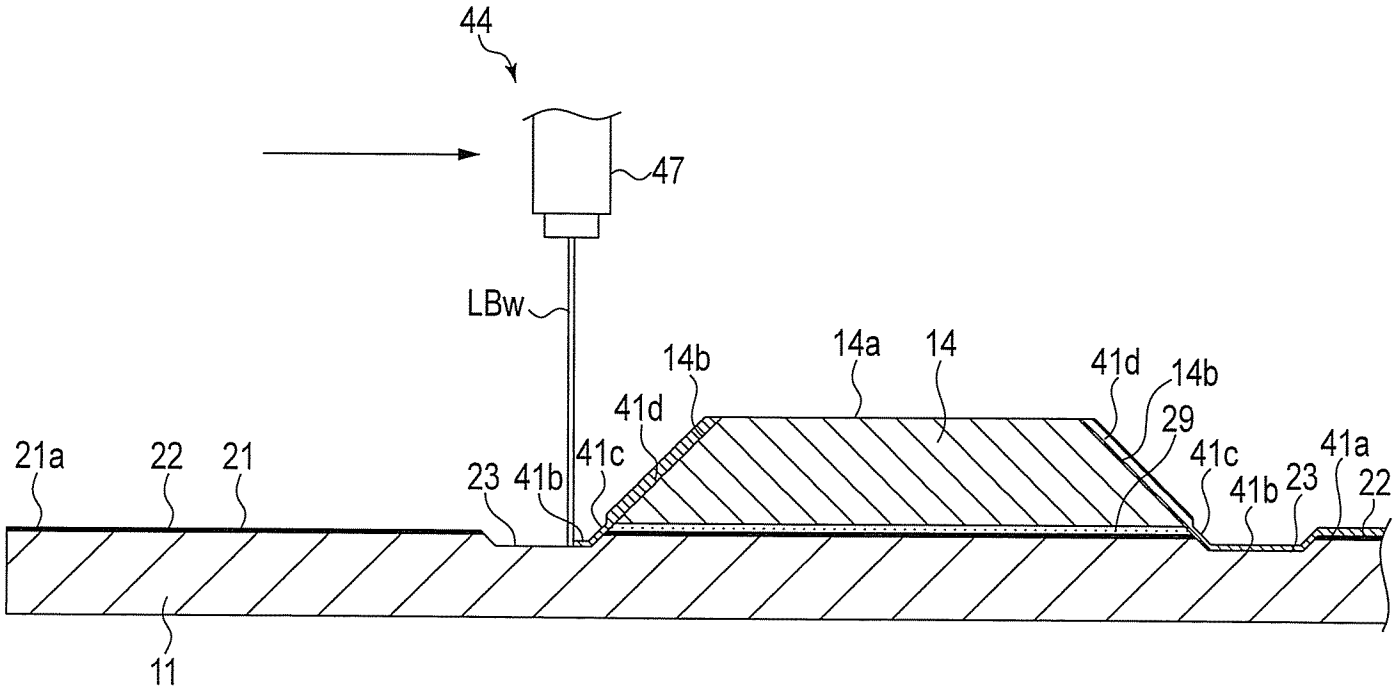
FIG. 5 is a schematic sectional view of the base plate and the driving element for explaining a process for shaving the nickel thin film in a second portion.

FIG. 5 is a schematic sectional view of the base plate 11 and the driving element 14 for explaining a process for shaving the nickel thin film 41*b*. When the machining point of the laser beam LB reaches the second portion 23 of the mounting surface 21, the power of the laser beam LB is reduced according to the nickel thin film 41*b* having the adhesion force with the base lower than the adhesion force of the nickel thin film 41*a*. For example, the glass plate of the attenuator 46 is caused to pivot to reduce the power of the laser beam LB. However, this is not a limitation. The power of the laser beam LB may be reduced by reducing the electric current applied to the laser diode 45, separating the beam emitting section 47 from the base plate 11, or expanding the diameter of the laser beam LB. Consequently, the laser machining apparatus 44 irradiates a laser beam LBw having power lower than the power of the laser beam LB for shaving the nickel thin film 41*a*.

As shown in FIG. 5, a machining point of the laser beam LBw is moved toward the driving element 14, whereby the nickel thin film 41*b* is shaved by the laser beam LBw. The machining point of the laser beam LBw may meander according to the shape of the wiring patterns 35.

Figure 6:
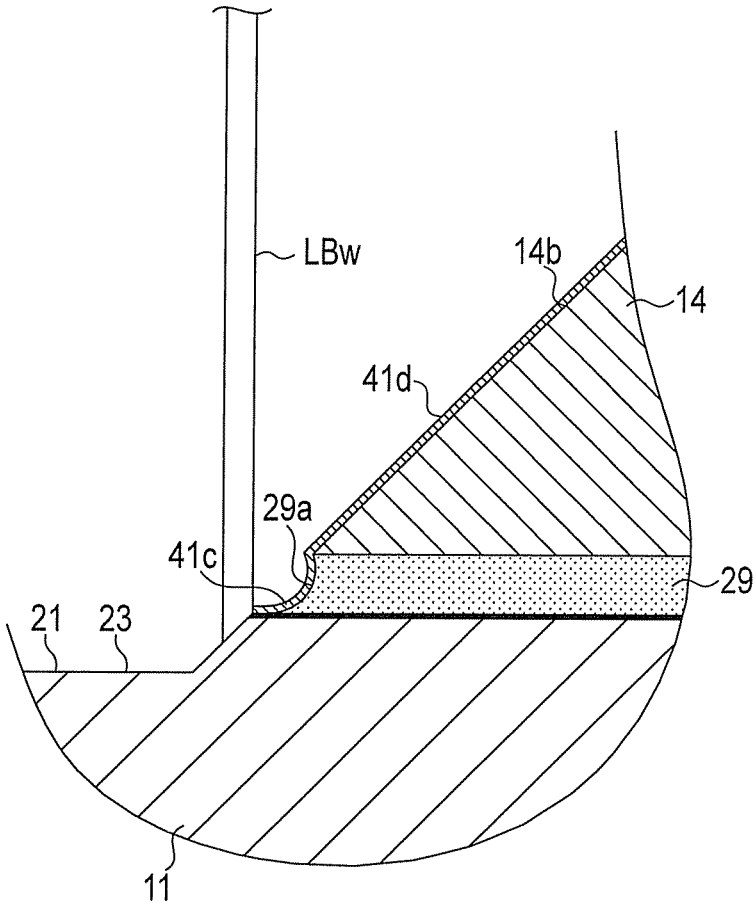
FIG. 6 is an enlarged sectional view of the base plate and the driving element around a bonding layer.
Figure 7:
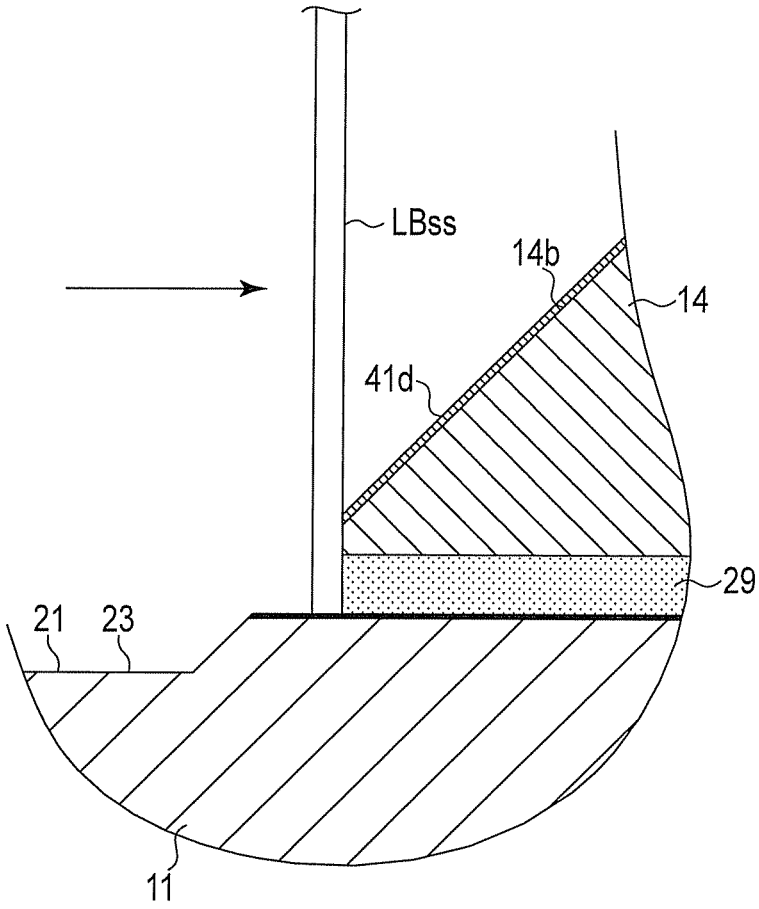
FIG. 7 is a schematic sectional view of the base plate and the driving element for explaining a process for shaving the nickel thin film on the bonding layer.

FIG. 6 is an enlarged sectional view of the base plate 11 and the driving element 14 around the bonding layer 29. FIG. 7 is a schematic sectional view of the base plate 11 and the driving element 14 for explaining a process for shaving the nickel thin film 41*c*. As shown in FIG. 6, the bonding layer 29 sometimes includes a concave surface 29*a* formed to be hollowed by air bubbles.

When the machining point of the laser beam LBw reaches the bonding layer 29, the power of the laser beam LBw is increased according to the nickel thin film 41*c* that is formed in the concave surface 29*a* and less easily shaved. For example, the power of the laser beam LBw is increased by bringing the beam emitting section 47 close to the bonding layer 29. The power of the laser beam LBw may be increased by other methods. Consequently, the laser machining apparatus 44 irradiates a laser beam LBss having power higher than the power of the laser beam LB for shaving the nickel thin film 41*a*.

A machining point of the laser beam LBss is moved toward the center of the base plate 11, whereby the nickel thin film 41*c* is shaved together with respective ends of the bonding layer 29 and the driving element 14 by the laser beam LBss as shown in FIG. 7.

Figure 8:
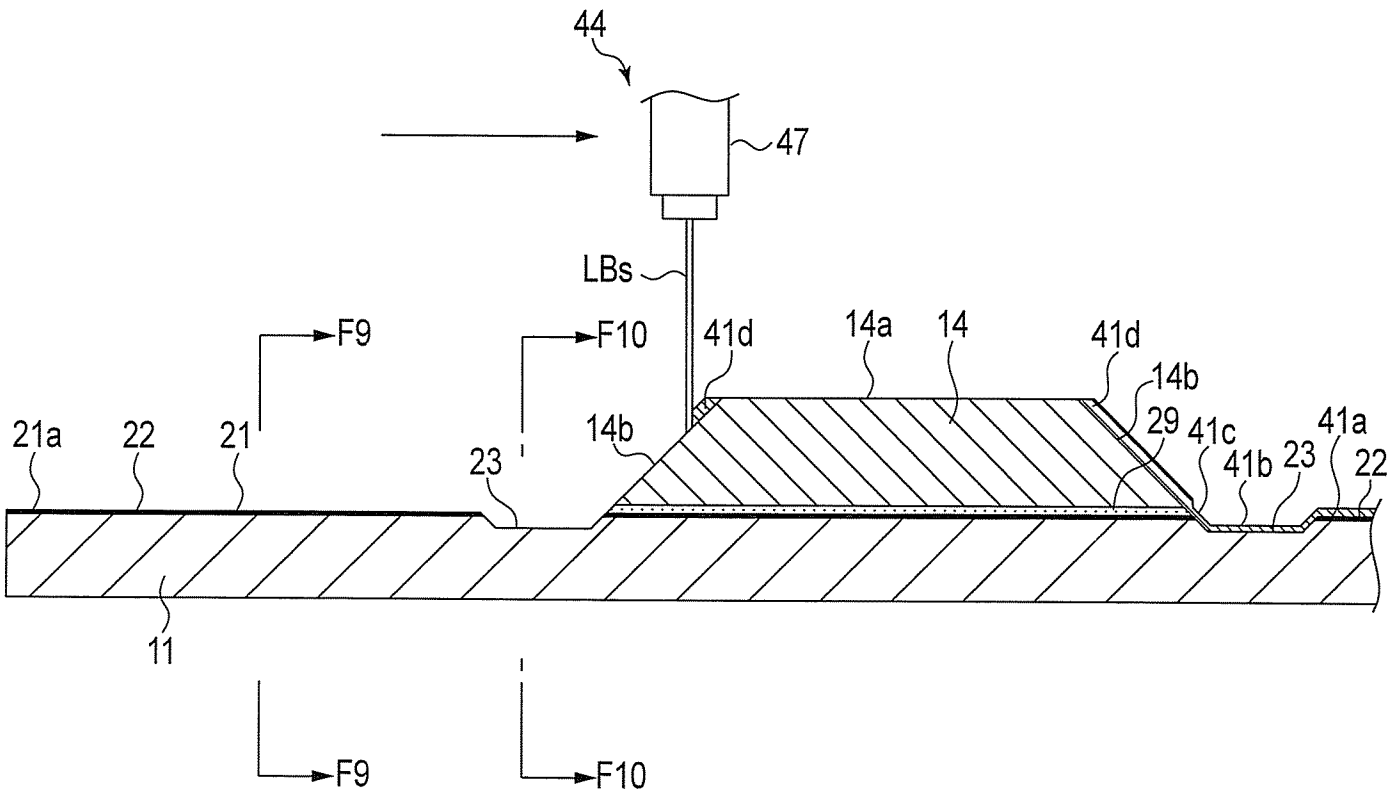
FIG. 8 is a schematic sectional view of the base plate and the driving element for explaining a process for shaving the nickel thin film on the driving element.

FIG. 8 is a schematic sectional view of the base plate 11 and the driving element 14 for explaining a process for shaving the nickel thin film 41*d*. When the laser beam LBss finishes shaving the nickel thin film 41*c*, the power of the laser beam LBss is reduced according to the nickel think film 41*d*. The nickel thin film 41*d* has the adhesion force with the base higher than the adhesion force of the nickel thin film 41*a*. On the other hand, power for shaving the nickel thin film 41*d* may be lower than power for shaving the end of the driving element 14. For example, the power of the laser beam LBss is reduced by moving the beam emitting section 47 away from the driving element 14. The power of the laser beam LBss may be reduced by other methods. Consequently, the laser machining apparatus 44 irradiates a laser beam LBs having power higher than the power of the laser beam LB for shaving the nickel thin film 41*a* and lower than the power of the laser beam LBss for shaving the nickel thin film 41*c*.

As shown in FIG. 8, the machining point of the laser beam LBs is moved toward the center of the base plate 11, whereby the nickel thin film 41*d* formed on the inclined surfaces 14*b* of the driving element 14 is shaved by the laser beam LBs.

Thereafter, the power of the laser beam is changed according to the nickel thin films 41*a*, 41*b*, 41*c*, and 41*d* as explained above to shave the nickel thin films 41*a*, 41*b*, 41*c*, and 41*d* to the other side end 21*b* of the mounting surface 21. Such patterning is repeated to form the plural wiring patterns 35 and the plural electrodes 32. The process for manufacturing the base plate 11 ends.

Figure 9:
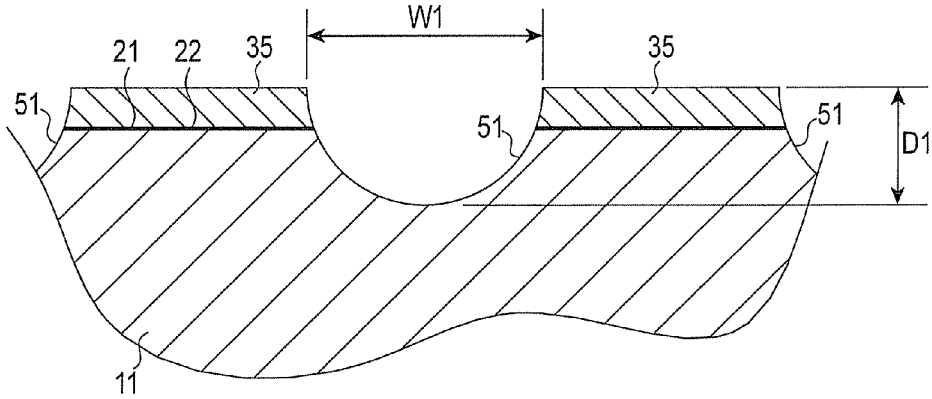
FIG. 9 is a sectional view of a part of the base plate taken along line F9-F9 in FIG. 8.
Figure 10:
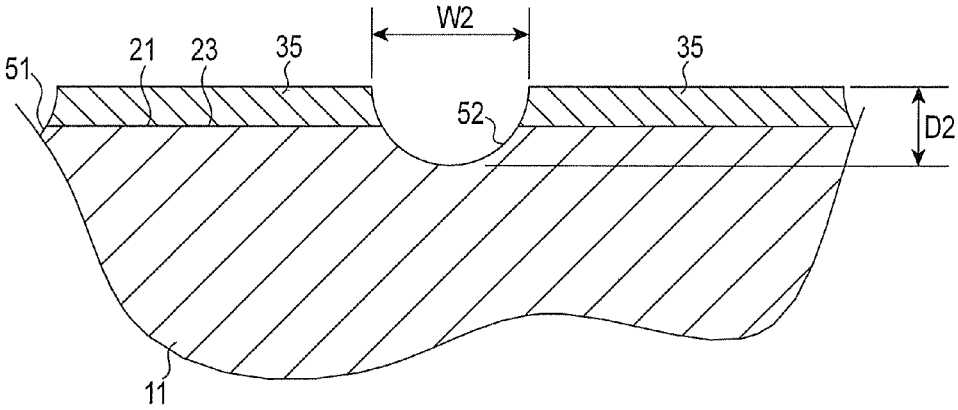
FIG. 10 is a sectional view of another part of the base plate taken along line F10-F10 in FIG. 8.

FIG. 9 is a sectional view of a part of the base plate 11 taken along line F9-F9 in FIG. 8. FIG. 10 is a sectional view of another part of the base plate 11 taken along line F10-F10 in FIG. 8.

The laser beam shaves the nickel thin films 41*a*, 41*b*, 41*c*, and 41*d*, whereby plural concave sections 51 and 52 are formed on the base plate 11. Each of the concave sections 51 and 52 is provided between two wiring patterns 35.

The concave sections 51 are formed by shaving the first portion 22 of the mounting surface 21 with the laser beam LB. The concave sections 52 are formed by shaving the second portion 23 of the mounting surface 21 with the laser beam LBs.

Since the nickel thin films 41*a*, 41*b*, 41*c*, and 41*d* are shaved by changing the power of the laser beam as explained above, the width and depth of the concave sections 51 and the width and depth of the concave sections 52 are different. For example, width W1 and depth D1 of the concave section 51 formed by the laser beam LB are larger than width W2 and depth D2 of the concave section 52 formed by the laser beam LBw. Similarly, the width and depth of concave sections formed on the inclined surfaces 14*b* of the driving element 14 by the laser beam LBs are larger than the width W1 and depth D1 of the concave section 51.

In the inkjet head 10 having the configuration explained above, the adhesion force between the second portion 23 and the nickel thin film 41*b* is lower than the adhesion force between the first portion 22 and the nickel thin film 41*a*. The nickel thin film 41*b* is thinner than the nickel thin film 41*a*. Therefore, the nickel thin film 41*a* of the first portion 22 of the base plate 11 is shaved by the laser beam LB and the nickel thin film 41*b* of the second portion 23 is shaved by the laser beam LBw. In this way, the power of the laser beam is adjusted according to differences in characteristics of the bases such as adhesion forces, thickness, and thermal properties. Consequently, it is possible to suppress a patterning defect in which a nickel thin film is partially excessively peeled or the nickel thin film is insufficiently cut.

Further, the nickel thin film 41*d* on the inclined surfaces 14*b* of the driving element 14 is shaved by the laser beam LBs having the power higher than the power of the laser beam LB. The nickel thin film 41*c* on the bonding layer 29 and the ends of the bonding layer 29 and the driving element 14 are shaved by the laser beam LBss having the power higher than the power of the laser beam LBs. In this way, the power of the laser beam is variously adjusted according to the differences in characteristics of the bases such as adhesion forces, thickness, and thermal properties. Consequently, it is possible to suppress a patterning defect.

With the method of manufacturing an inkjet head according to the at least one embodiment explained above, a metal film formed in a first portion of a base member is shaved by a laser beam and a metal film formed in a second portion of the base member is shaved by a laser beam having power different from the power of the laser beam for shaving the metal formed in the first portion to form conductor patterns. Consequently, it is possible to suppress a patterning defect.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of manufacturing an inkjet head comprising:

forming metal films respectively on a surface of a base member comprising a first portion and a second portion smoother than the first portion and a surface of a driving element attached to the base member; and shaving the metal film formed in the first portion of the base member with a first laser beam and shaving the metal film formed in the second portion of the base member with a second laser beam having power different from power of the first laser beam to form a conductor pattern.

2. The method of claim 1, wherein the second laser beam has the power lower than the power of the first laser beam.

3. The method of claim 2, wherein, when the conductor pattern is formed, the metal film formed on the surface of the driving element is shaved by a third laser beam having power higher than the power of the first laser beam.

4. The method of claim 3, wherein, when the conductor pattern is formed, the metal film formed on a bonding layer interposed between the base member and the driving element is shaved by a fourth laser beam having power higher than the power of the third laser beam.

5. The method of claim 4, wherein a laser machining apparatus that irradiates a laser beam includes a laser diode, and power of the laser beam is changed by changing a current value of the laser diode.

6. The method of claim 4, wherein a laser machining apparatus that irradiates a laser beam includes an attenuator capable of variably reducing power of the laser beam, and the power of the laser beam is changed by the attenuator.

7. The method of claim 4, wherein a laser machining apparatus that irradiates a laser beam includes a beam emitting section where the laser beam is emitted, and the power of the laser beam is changed by changing a distance between the beam emitting section and a machining point.

8. The method of claim 4, wherein the power of the laser beam is changed by changing a diameter of the laser beam.

9. The method of claim 1, wherein a laser machining apparatus that irradiates a laser beam includes a laser diode, and power of the laser beam is changed by changing a current value of the laser diode.

10. The method of claim 1, wherein a laser machining apparatus that irradiates a laser beam includes an attenuator capable of variably reducing power of the laser beam, and the power of the laser beam is changed by the attenuator.

11. The method of claim 1, wherein a laser machining apparatus that irradiates a laser beam includes a beam emitting section where the laser beam is emitted, and the power of the laser beam is changed by changing a distance between the beam emitting section and a machining point.

12. The method of claim 1, wherein the power of the laser beam is changed by changing a diameter of the laser beam.

13. A method of manufacturing an inkjet head comprising:

forming metal films respectively on a surface of a base member and a surface of a driving element attached to the base member; and shaving the metal film formed on the base member with a first laser beam and shaving the metal film formed on the driving element with a second laser beam having power different from power of the first laser beam to form a conductor pattern.

14. The method of claim 13, wherein the first laser beam has the power lower than the power of the second laser beam.

* * * * *